US005913295A

United States Patent [19]

Sadr et al.

[11] Patent Number: 5,913,295

[45] Date of Patent: Jun. 22, 1999

[54] COMBINATION AIR CLEANER FLUID RESERVOIR

[75] Inventors: Changize Sadr, North York; Robert Graham, Thornhill; Kimberly Winters, Scarborough, all of Canada

[73] Assignee: Salflex Polymers Ltd., Toronto, Canada

[21] Appl. No.: 08/903,288

[22] Filed: Jul. 30, 1997

[51] Int. Cl.[6] ..... F02B 77/00

[52] U.S. Cl. ..... 123/198 E; 55/385.3; 181/228

[58] Field of Search ..... 123/198 E, 184.53, 123/184.57; 55/385.3, 498; 181/229; 96/386, 388

[56] References Cited

U.S. PATENT DOCUMENTS 4,440,555 4/1984 Chichester ..... 55/385.3
4,548,166 10/1985 Gest ..... 123/198 E
4,929,263 5/1990 Kasugai ..... 55/341.2
5,197,426 3/1993 Frangesch et al. ..... 123/198 E
5,433,772 7/1995 Sikora ..... 96/87
5,647,314 7/1997 Matsumura et al. ..... 123/184.57

*Primary Examiner*—Willis R. Wolfe
*Assistant Examiner*—Hai Huynh
*Attorney, Agent, or Firm*—Bereskin & Parr

[57] ABSTRACT

For use with a vehicle, a combination unit includes a fluid storage chamber for storing fluids such as windshield washer fluid and an acoustic resonance chamber for attenuating vehicle air intake noises. The fluid storage container and the acoustic resonance chamber are hingedly attached and define there between an airflow cavity for housing the vehicle air filter with suitable ducting to direct ambient air through the filter and into the engine intake system.

12 Claims, 4 Drawing Sheets

COMBINATION AIR CLEANER FLUID RESERVOIR

FIELD OF THE INVENTION

This invention relates to air handling systems, in particular, for filtering ambient air to be fed to a device requiring a source of clean air. In particular, the invention relates to providing filtered air to internal combustion engines.

BACKGROUND

Many vehicles are powered by internal combustion engines. Internal combustion engines require a source of air normally for combustion of the fuel involved. The combustion air is drawn from the ambient air surrounding the vehicle. The ambient air may contain dust or fume particles which if ingested into the engine would damage such an engine or reduce its useful life. Typically, therefore the induction passage of the engine includes a filter. Some type of housing must be made which supports the filter element and which guides air to force it to pass through the filtration element and then to duct the filtered air to the engine intake passages.

It is also common in vehicles, particularly vehicles which travel on roads, to provide a source of fluid to be used in cleaning viewing surfaces, principally the windshield of the vehicle. Fluid may be required to clean a front windshield or a rear window or any other surface through which the operator may wish to have an unobstructed view. Typically, vehicles are equipped with a housing which comprises a fluid storage chamber. The storage chamber may have a sump or other means to accommodate a fluid pump. Fluid may then be pumped from the storage chamber to nozzles or other like devices around the vehicle to assist in cleaning viewing surfaces.

Heretofore the fluid storage chamber has been independent of any ambient air flow chambers. Typically ducting is provided to the air flow chamber and the air flow chamber is supported on the engine or the vehicle as needed. Additionally, the fluid reservoir chamber is also located on the vehicle wherever space permits and means are provided to mount the fluid reservoir chamber on either the engine or the vehicle as desired.

Typically the filter elements for such vehicles require replacement from time to time and thus the housing defining the flow paths for the ambient air through the filter element must be openable in some fashion to permit replacement or cleaning of the filtration element.

SUMMARY OF THE INVENTION

It has been recognized that it would be cost effective to provide a combined unit which serves the purpose of providing a fluid storage chamber and which also provides suitable air induction system including the location of a replaceable filtration element together with suitable flow passages. In accordance with this invention an air induction device for use with a vehicle requiring a source of filtered air comprises a first housing defining a liquid storage chamber and a second housing defining an acoustic resonance chamber, the first and second housings define therebetween, at least in part, an air flow chamber. The air flow chamber is adapted to contain a filter element. The combined unit has an inlet for ambient air and an air outlet for filtered air. The air flow chamber communicates with the acoustic resonance chamber for modifying acoustic characteristics.

The invention will be better understood in connection with a review of the attached drawings which illustrate a preferred embodiment of the invention, and in which.

Figure 1:
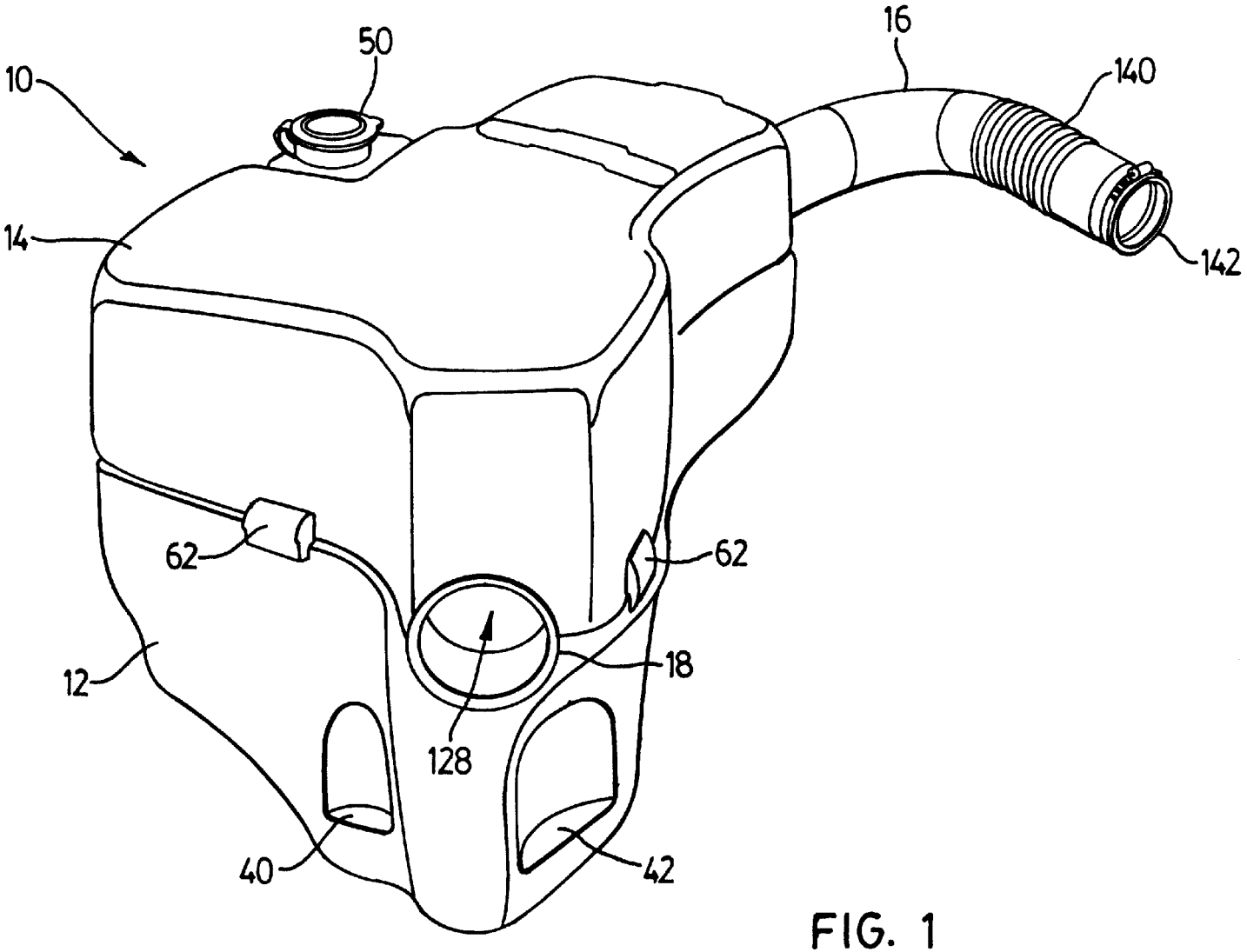
FIG. 1 is a perspective view of preferred embodiment of the air induction device in accordance with the invention.

The air induction device is indicated generally at 10 and is shown in FIG. 1. The air induction device comprises a first housing 12 and a second housing 14. Filtered air is delivered from the air induction device by means of clean air outlet duct 16 to the internal combustion engine or other source. Ambient air is drawn from the surrounding air and inducted into the air induction device through the intake snorkel 18.

Figure 3:
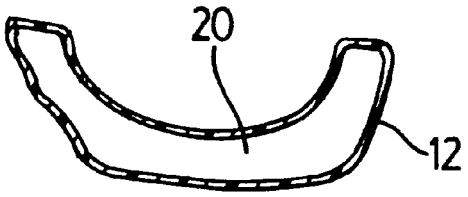
FIG. 3 is a cross-section through the housing of FIG. 2 taken along the plane 3—3 identified in FIG. 2.
Figure 2:
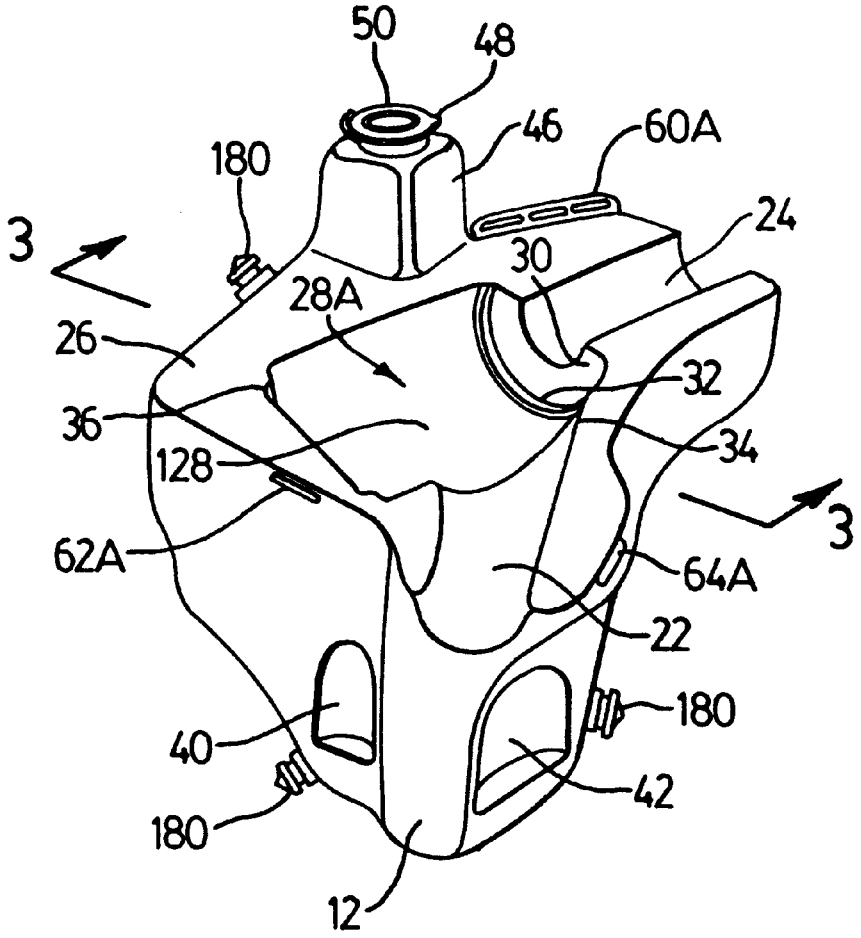
FIG. 2 is a perspective view of the first housing of the device illustrated in FIG. 1.

The first housing 12 is illustrated in FIG. 2. The housing 12 defines a closed liquid storage chamber 20. The chamber 20 is visible in the cross-sectional view in FIG. 3. The housing 12 defines an inlet passage 22 and an outlet passage 24. Each of the inlet passage 22 and the outlet passage 24 are substantially semi-cylindrical, although the exact configuration is a matter of choice. The inlet passage 22 and the outlet passage 24 both open towards the substantially planar face 26 of the housing 12. The housing 12 also defines a recessed, substantially semi-cylindrical surface 28A. The surface 28A defines in part, an air flow chamber 128.

The surface 28A comprises a series of lands to position and seal a filter element to be discussed later. The filter positioning and sealing arrangements comprise the substantially semi-annular wall 30, the substantially semi-cylindrical wall 32 and the substantially semi-annular wall 34. A similar set of walls is partially visible in FIG. 2 and has been marked 36. It will be appreciated that the surfaces at 36 are mirror images of those shown at 30, 32 and 34. The semi-cylindrical surface 32 and its mirror image at 36 serve to locate the filter which will have cylindrical walls at either end. The length and diameter of the surface 28A is designed to accommodate the particular style of filter required.

The housing 12 may also conveniently define fluid pump locating elements. A recess 40 is sufficiently large to accommodate a single fluid pump. The similar recess 42 is large enough to accommodate two such fluid pumps. Thus, in the device shown in FIG. 3, three fluid delivery pumps can be accommodated by the device. Each of the fluid pumps will have an aperture communicating with the interior of the fluid storage chamber 20. The pumps which are not shown in FIG. 2, but which may be located in the recesses 40 and 42 and can then be used to deliver fluid to one or more purposes as desired by the vehicle operator.

In order to add fluid to the chamber 20 from time to time the housing 12 defines an upstanding filler neck 46. Mounted on top of the filler neck there is an aperture 48 which is closed by a cover 50. In order to add fluid to the chamber, the cover 50 is removed and the desired fluid is poured through the aperture 48 into the chamber 20.

The housing 12 also comprises a hinge 60A. The hinge 60A is located on the surface 26 adjacent to the filler neck 46. The housing 12 also defines two latch components 62A and 64A. The function of the hinge 60A and the latch components 62A and 64A will be discussed below.

Figure 4:
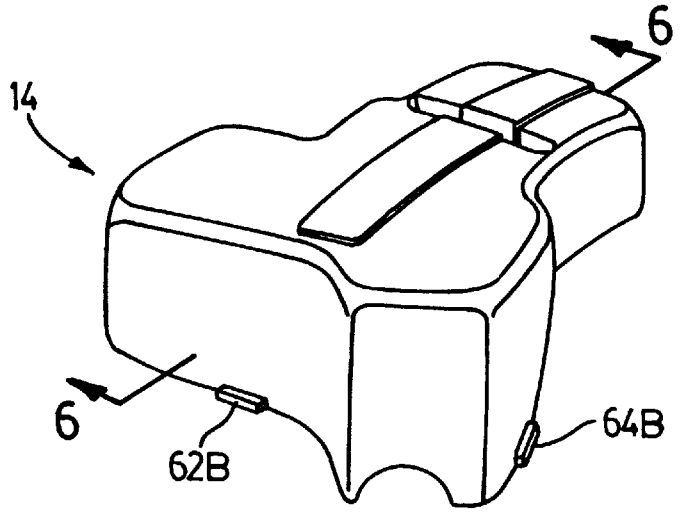
FIG. 4 is a perspective view of the second housing of the device shown in FIG. 1.
Figure 6:
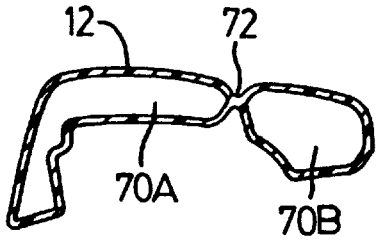
FIG. 6 is a cross-sectional view through the housing of FIG. 4 along the plane identified by the numerals 6—6 in FIG. 4.
Figure 5:
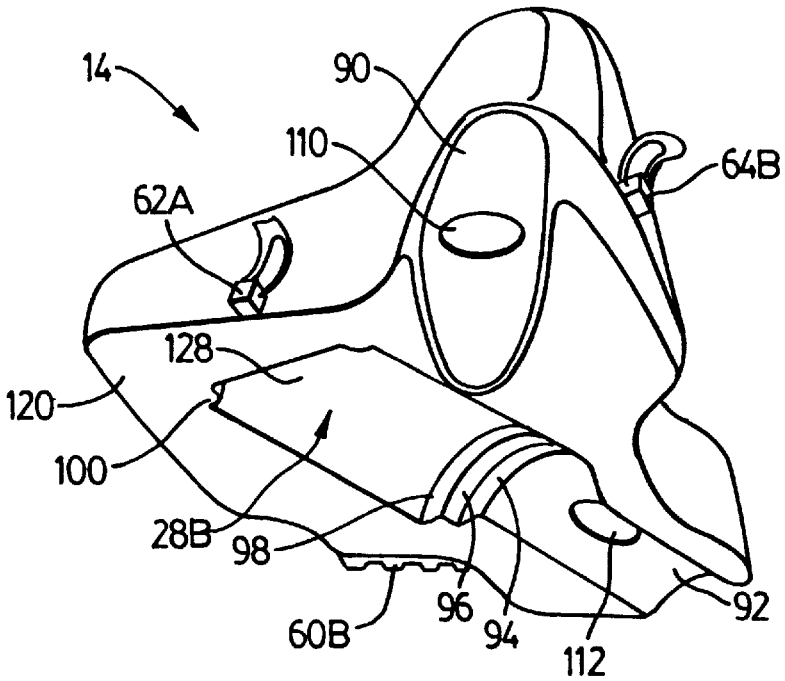
FIG. 5 is a bottom view of the housing shown in FIG. 4.

The second housing 14 is illustrated in FIGS. 4, 5 and 6. The second housing 14 defines an acoustic resonance chamber. In this case the acoustic resonance chamber comprises two separated chambers 70A and 70B. The two separate acoustic resonance chambers are visible in FIG. 6. The two separate chambers 70A and 70B are separated one from another by pinching the walls of the housing 14 together at 72 as illustrated in FIG. 6.

With reference to FIG. 5 which illustrates the bottom of the device shown in FIG. 4, it will be observed that the housing 14 defines an inlet passage 90 and an outlet passage 92. The inlet passage 90 and the outlet passage 92 are each substantially semi-cylindrical in shape and have essentially the same dimensions of length and diameter respectively as the passages 22 and 24 in first housing 12. The second housing 14 also defines a recessed semi-cylindrical surface 28B. The surface 28B is similar in size and configuration to the surface 28A of housing 12. In order to further position the filter element the surface 28B comprises a substantially semi-annular wall 94, a substantially semi-cylindrical wall 96 and a substantially semi-annular wall 98. The interaction of the walls 94, 96 and 98 is the same as the walls 30, 32 and 34 of the housing 12. The housing 14 also comprises similar arrangement of walls indicated generally in FIG. 5 by the numeral 100. At 100 there are three walls which are the mirror images of the walls 94, 96 and 98. These walls also serve to position and seal a replaceable filter element.

The housing 14 also defines a hinge element 60B and a pair of latch components 62B and 64B.

From reference to FIG. 5 it will be noted that the housing 14 includes a first port 110 in the surface of the inlet passage 90. The first port 110 communicates with the acoustics resonance chamber 70A. The outlet passage 92 of the housing 14 also includes a second port 112. The port 112 communicates with the acoustic resonance chamber 70B.

The second housing 14 has a substantially planar surface 120.

In use, the second housing 14 is surmounted on the first housing 12. With the two housings located adjacent one another as shown in FIG. 1, then the surface 120 will lie on and be supported by the surface 26 of the first housing 12. When in that configuration and location, the inlet passage 22 and the inlet passage 90 combine to form a substantially closed cylindrical passage. Similarly, the outlet passage 24 and the outlet passage 92 combine to form a substantially closed cylindrical passage. The surface 28B of the housing 14 and the surface 28A of the housing 12 combine to form a substantially closed cylindrical air flow chamber which is adapted to contain a filter element.

In order to keep the housing 12 and the housing 14 attached together and located as indicated above, the hinge means 60A of the housing 12 and the hinge means 60B of the housing 14 are hingedly interconnected to provide a pivoting axis along the hinge members 60A and 60B. When the first and second housings 12, 14 are pivoted about the axis of the hinge 60A–60B to a closed position, the surfaces 120 and 126 will be in contact. When those surfaces are in contact with one another, the latch components 62A and 62B will be adjacent one another as will the latch components 64A and 64B. By connecting the latch components together the housings form a single integral unit. When in the closed position, housing 12 and 14 define between them the air flow chamber 128. When it is desired to separate the devices the latch components 62 and 64 can be disengaged and the housing 14 pivoted relative to housing 12 about the axis of hinge 60.

Figure 9:
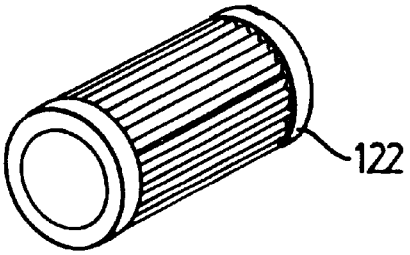
FIG. 9 is a filter element for use in association with the device shown in FIG. 1.

FIG. 9 illustrates a cartridge filter element 122. The cartridge element may be of any size and configuration as desired. Most conveniently this may be a cylindrical element of paper such as a so-called dry filter. The filter element 122 is configured so as to be sealingly received within the walls 30, 32, 34, 94, 96, 98 as shown in FIGS. 2 and 5. The filter element has two ends which are substantially identical. The other end of the filter element is received in the walls indicated generally at 36 in FIG. 2 and 100 in FIG. 5 so that the filter is sealingly received within the portion of the air flow chamber 120 defined by surfaces 28A and 28B.

Figure 7:
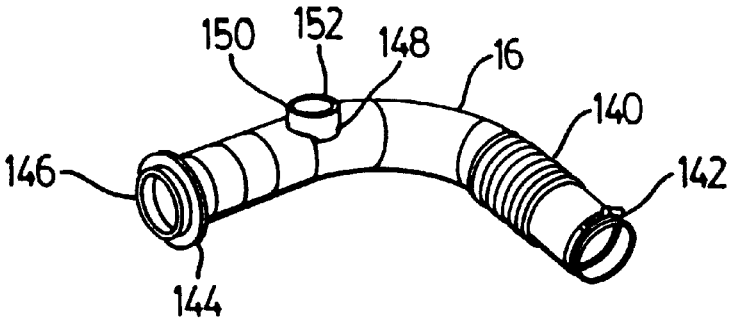
FIG. 7 illustrates a clean air outlet duct of the device of FIG. 1.

FIG. 7 illustrates the clean air outlet duct 16. The clean air outlet duct comprises a substantially tubular portion having a bellows section 140. The clean air outlet duct has an aperture 142 at the outlet end of the outlet duct. The duct 16 may be attached to the engine components to feed filtered air directly to the engine. The bellows section 140 facilitates aligning the outlet 142 with the engine. The inlet end 144 of the clean air outlet duct 16 includes a substantially cylindrical seal 146. The seal 146 of the outlet duct 16 communicates with the interior surface of the filter element 122 to provide a gas tight seal. The clean air outlet duct 16 also comprises an upstanding collar 148 having an aperture 150 and a substantially cylindrical seal 152. The upstanding collar 148 is received within the aperture 112 visible in FIG. 5. The seal 152 seals about the periphery of the aperture 112 to comprise a gas tight seal.

Figure 8:
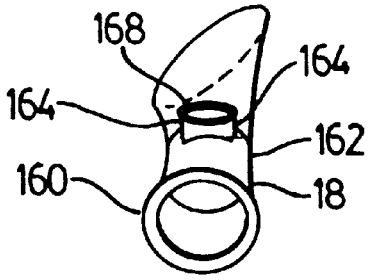
FIG. 8 is a perspective view of the intake snorkel of the device of FIG. 1.

FIG. 8 illustrates the intake snorkel 18. The intake snorkel 18 comprises a horn-shaped inlet 160 and a substantially cylindrical tubular passage 162. There is an upstanding cylindrical collar 164 having an aperture 166 and a substantially cylindrical seal 168. The upstanding collar 162 is received within the aperture 110. When the housings 12 and 14 are in the closed position, the clean air outlet duct is captured within passages 24 and 92 and the intake snorkel is captured between passages 22 and 90. Thus, in this preferred emboidment, the air flow chamber 128 includes the intake snorkel 18, the surfaces 28A and 28B and the clean air outlet duct 16.

The housing 12 comprises mounting means 180 illustrated in FIG. 2 in order that the housing 12 may be conveniently mounted to a support portion of the vehicle in which the air induction device is to be used.

With reference to FIGS. 2 and 5, it will be observed that the housing 14 comprises a relieved portion 190 at the peripheral edge. That portion 190 curves about the upstanding filler neck 46 of the housing 12.

The device as illustrated in FIG. 1 functions as follows. The housing 12 will be affixed to the vehicle in some suitable location. The location is chosen so that the inlet horn 160 of the intake snorkel 18 has access to free flowing air. The air drawn into the internal combustion engine creates a vacuum pressure in the clean air outlet duct 16. That vacuum pressure will draw air into the intake snorkel 18. As the air flows along the intake snorkel it will be delivered from the intake snorkel 18 to the exterior of the portion of the air flow chamber 128, formed by the surfaces 28A and 28B. The air can flow circumferentially around the entire surface formed by the surfaces 28A and 28B exterior to the filter element 122. The air can then flow through the filter element 122 radially inwardly whereupon it is filtered. The filtered air is then drawn into the clean air outlet duct 16.

The two surfaces, 120 of housing 14 and 26 of housing 12, need not be in sealing engagement in this emboidment. The vacuum pressure created by the engine is sealed by means of seal 146 with the interior of the filter element 122. Accordingly, even if some air does pass along the intersection of surfaces 120 and 26, that air cannot reach the engine intake passage without travelling through the filter element 122. In order to ensure that this occurs the filter element 122 must be sealed at either end. This is accomplished by the interaction of walls 30, 32, 34 of the first housing 12 and similar walls 94, 96, 98 of the housing 14. Similar sealing occurs at the areas indicated generally by the numbers 36 and 100.

It is well-known to those familiar with designing internal combustion engines that substantial noise is created in the air intake passageway. It is also well understood by those skilled in this art that acoustics resonance chambers may be designed to attenuate the noise significantly. The most effective attenuation of noise can be achieved by two separate chambers located on either side of the filtration barrier. Thus, the intake snorkel 18 communicates with the first acoustic resonance chamber 70A by means of the collar 162. Similarly, the clean air outlet duct 16 communicates with the acoustics resonance chamber 70B by means of the upstanding collar 148 and its seal 152. The size, configuration and location of the acoustic chamber can be arranged to meet the design requirements of the designer. Those features are well understood by those familiar with air intake silencing technology.

The filter element 122 will require replacement from time to time on a regular basis. When it is desired to replace the filter element the latch elements 62 and 64 are disengaged. The housing 14 is pivoted about the hinge 60. With the housing 12 and 14 then in the open position, the filter element 122 may be easily removed from the device and replaced with a clean element.

With reference to FIG. 1 it will be observed that the upstanding filler neck 46 is substantially long enough to provide easy access to the filler aperture 48. Accordingly, when the two housings are held together by the latch components 62 and 64, the cap 50 and the aperture 48 of the liquid storage chamber remain available for access. Accordingly, when it is desired to add fluid to the fluid storage chamber, it is necessary only to remove the cap 50 and pour fluid into the chamber 20.

As shown and discussed in this preferred embodiment, the first housing 12 defining the liquid storage chamber is vertically below the second housing 14 defining the acoustic resonance chamber. However, the configuration of the parts may be altered as desired by the designer. The chambers need not be one on top of the other, but could be arranged side by side or in other configuration as desired. It is believed however that the configuration illustrated in this embodiment is the most desirable, providing for efficient location and flow of liquid to pumps which may be placed in the recesses 40 and 42 as well as convenient access to the replaceable filter element.

The housings 12 and 14 are essentially hollow members which may have any configuration desirable. The constraints on the configuration will involve not only the acoustic resonance attenuation but also the physical limitations within the vehicle where the device is to be located. Relatively complicated hollow shapes of this type may be manufactured easily from blow molded parts. When designing the molds to accept such blow molded parts consideration must be given to the flow of the blow moldable resin. Taking all of the design constraints into account, it may be that the surfaces 120 and 26 are not essentially planar surfaces. Other shapes may also be appropriate depending upon the many considerations referred to above. Even if the surfaces 26 and 120 are essentially planar surfaces, it is by no means required that those surfaces be presented in a substantially horizontal direction. Similarly, while all of the air flow passages described above, including those accommodating the intake snorkel and the clean air outlet duct as well as the chamber containing the filtration element are substantially cylindrical in configuration, such shape is not necessarily required. It is also not necessary that the surfaces 26 and 120 pass along a diameter of any one or more of those air flow passages, although this is clearly the desired configuration to assist in assembly and disassembly of this device.

Various other modifications and changes can be made and all such changes are contemplated by this invention. The invention has been disclosed in association with a preferred embodiment of the invention and the scope of the invention should be determined solely by reference to the appended claims.

We claim:

1. An air induction device for use with a vehicle requring a source of filtered air comprising a first housing defining a liquid storage chamber and a second housing defining an acoustic resonance chamber, said first and second housings defining therebetween at least in part, an air flow chamber, said air flow chamber adapted to contain a filter element, said device having an air flow path including an air inlet for ambient air and an air outlet for filtered air, said air flow path communicating with said acoustic resonance chamber.

2. An air induction device as claimed in claim 1 comprising hinge means on said first and second housings to provide relative pivotal movement.

3. An air induction device as claimed in claim 1 comprising latch components on each housing.

4. An air induction device as claimed in claim 1 comprising seals on said housings to define an air flow path between said inlet and said outlet to direct air flow through said filter element.

5. An air induction device as claimed in claim 1, said fluid housing defining at least one pump cavity.

6. An air induction device as claimed in claim 5, said fluid housing defining a multiple pump cavity.

7. An air induction device as claimed in claim 1 said second housing defining a plurality of acoustic resonance chambers.

8. An air induction device as claimed in claim 1 wherein one acoustic resonance chamber communicates with said inlet.

9. An air induction device as claimed in claim 1 wherein one acoustic resonance chamber communicates with said outlet.

10. An air induction device as claimed in claim 1 wherein said fluid chamber is vertically below said acoustic resonance chamber.

11. An air induction device as claimed in claim 10 wherein said first housing includes a fluid fill opening adjacent a top surface of said device.

12. An air induction device as claimed in claim 1, wherein said first housing further comprises mounting means for mounting said device to a vehicle.

* * * * *